US005823395A

United States Patent [19]

Foster et al.

[11] Patent Number: 5,823,395

[45] Date of Patent: Oct. 20, 1998

[54] CHILD-RESISTANT PUMP DISPENSER

[75] Inventors: Donald D. Foster, St. Charles, Mo.; Bert D. Heinzelman, Tenafly, N.J.; Donald R. Lamond, Lynbrook, N.Y.; William Fiebel, Passaic, N.J.

[73] Assignee: Continental Sprayers International, Inc., St. Peters, Mo.

[21] Appl. No.: 847,450

[22] Filed: Apr. 24, 1997

[51] Int. Cl.[6] ..... B67D 5/40

[52] U.S. Cl. ..... 222/153.02; 222/153.13; 222/384; 239/333

[58] Field of Search ..... 222/153.02, 153.13, 222/153.14, 383.1, 384; 239/333

[56] References Cited

U.S. PATENT DOCUMENTS

| | | | |
|---|---|---|---|
| 3,927,834 | 12/1975 | Tada | 222/153.14 |
| 4,346,821 | 8/1982 | Wesner et al. | 222/153 |
| 4,441,633 | 4/1984 | Bennett | 222/153 |
| 4,454,965 | 6/1984 | Kirk, Jr. | 222/153 |
| 4,506,805 | 3/1985 | Marcon | 222/153 |
| 4,516,695 | 5/1985 | Garneau | 222/153 |
| 4,538,745 | 9/1985 | Dunning et al. | 222/153 |
| 4,889,262 | 12/1989 | Toms | 222/153.13 |
| 4,946,074 | 8/1990 | Grogan | 222/153 |
| 5,040,702 | 8/1991 | Knickerbocker et al. | 222/153 |
| 5,092,493 | 3/1992 | Pehr | 222/153 |
| 5,114,049 | 5/1992 | Knickerbocker | 222/153 |
| 5,161,716 | 11/1992 | Knickerbocker | 222/153 |
| 5,238,152 | 8/1993 | Maas et al. | 222/153.14 |
| 5,297,701 | 3/1994 | Steijns et al. | 222/153 |
| 5,482,186 | 1/1996 | Rodden, Jr. | 222/153.02 |

*Primary Examiner*—Joseph Kaufman
*Attorney, Agent, or Firm*—Howell & Haferkamp, LC

[57] ABSTRACT

A child-resistant liquid dispenser, such as a trigger sprayer, includes a dispenser body, a pump mechanism having a pump piston, and a trigger connected to the pump piston so that movement of the trigger effectuates movement of the pump piston. The pump mechanism is configured to draw liquid into an intake port of the dispenser body and discharge it through a discharge port upon reciprocating movement of the pump piston. The child-resistant liquid dispenser also includes a first locking mechanism which is engageable with the pump piston in a manner to prevent movement of the pump piston when in a locked position. The first locking mechanism is configured to permit normal movement of the pump piston when in an unlocked position. The child-resistant liquid dispenser further includes a second locking mechanism. The second locking mechanism is configured to releasably engage the first locking mechanism in a manner to releasably retain the first locking mechanism in its locked position.

20 Claims, 8 Drawing Sheets

CHILD-RESISTANT PUMP DISPENSER

BACKGROUND OF THE INVENTION

This invention relates generally to manually operated pump dispensers such as trigger sprayers, and more particularly to such pump dispensers having child-resistant features.

Some conventional trigger sprayers have child-resistant features which make it difficult for a child to operate. A typical child-resistant trigger sprayer includes a nozzle assembly rotatable between "on" and "off" positions and a locking mechanism. The locking mechanism is engageable with the nozzle assembly in a manner to releasably prevent rotational movement of the nozzle assembly out of its "off" position. A problem with this type of apparatus is that only some trigger sprayers have nozzle assemblies which are rotatable between "on" and "off" positions.

Another conventional child-resistant trigger sprayer includes a locking mechanism for preventing movement of the trigger. The locking mechanism includes a latch pivotally mounted on an upper portion of the trigger. The latch has a rearwardly projecting extension with a blunt end configured to butt against a free end of the pump cylinder when the latch is in the locked position. The latch also has an arm projecting forwardly of the trigger to facilitate manual operation of the latch against the bias of a spring for unlocking the trigger to permit pumping. A problem with this apparatus is that it requires significant dexterity or strength to operate, making it inconvenient and difficult to operate even by an adult.

SUMMARY OF THE INVENTION

An object of the present invention is to provide a child-resistant pump dispenser which overcomes the disadvantages associated with conventional pump dispensers. Another object is the provision of a pump dispenser having child-resistant features which are not easily operated by a child, but which are easily operated by an adult. A further object of the present invention is the provision of a child-resistant pump dispenser which is capable of releasably preventing movement of the trigger and pump mechanism. Yet another object of the present invention is the provision of a child-resistant pump dispenser which is relatively low in cost and which is relatively simple in construction.

In general, a child-resistant liquid dispenser of the present invention comprises a dispenser body, a pump mechanism, a first locking mechanism, and a second locking mechanism. The dispenser body has an fluid intake port and a fluid discharge port. The pump mechanism is adjacent the dispenser body and includes a moveable member. The moveable member is moveable relative to the dispenser body between first and second positions along an axis. The pump mechanism is configured to draw liquid into the intake port and discharge it through the discharge port upon movement of the moveable member between its first and second positions. The first locking mechanism is adjacent the pump mechanism and dispenser body and is moveable between locked and unlocked positions. The first locking mechanism is engageable with both the moveable member of the pump mechanism and the dispenser body when the first locking mechanism is in its locked position in a manner to prevent movement of the moveable member from its first position to its second position. The first locking mechanism is configured to permit movement of the moveable member between its first and second positions when the first locking mechanism is in its unlocked position. The second locking mechanism is adjacent to the first locking mechanism and is configured to releasably engage the first locking mechanism in a manner to releasably retain the first locking mechanism in its locked position.

In another aspect of the present invention, a child-resistant liquid dispenser comprises a dispenser body, a pump mechanism, a locking mechanism, and a trigger. The dispenser body and the pump mechanism are similar in all respects to those described above. The locking mechanism is similar in all respects to the first locking mechanism described above. The trigger is moveable relative to the dispenser body between first and second positions and is engageable with the moveable member in a manner so that movement of the trigger between its first and second positions effectuates movement of the moveable member between its first and second positions.

Other objects and features will be in part apparent and in part pointed out hereinafter.

BRIEF DESCRIPTION OF THE DRAWINGS

Reference characters in the written specification indicate corresponding parts throughout the several views of the drawings.

DETAILED DESCRIPTION OF THE PREFERRED EMBODIMENTS

Figure 1:
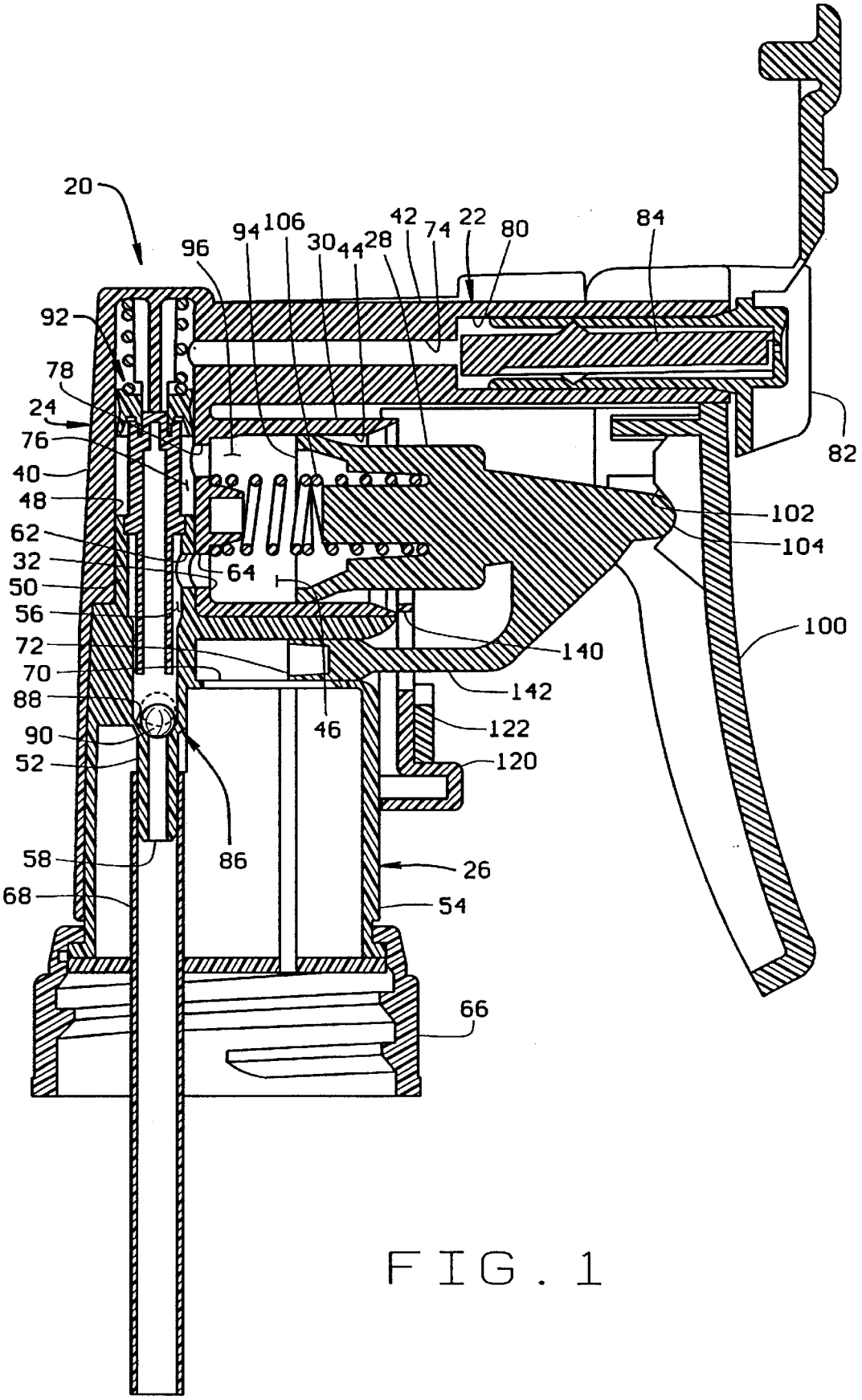
FIG. 1 is a sectional view of a liquid dispenser of the present invention having a linearly moveable locking mechanism shown in a locked position.
Figure 2:
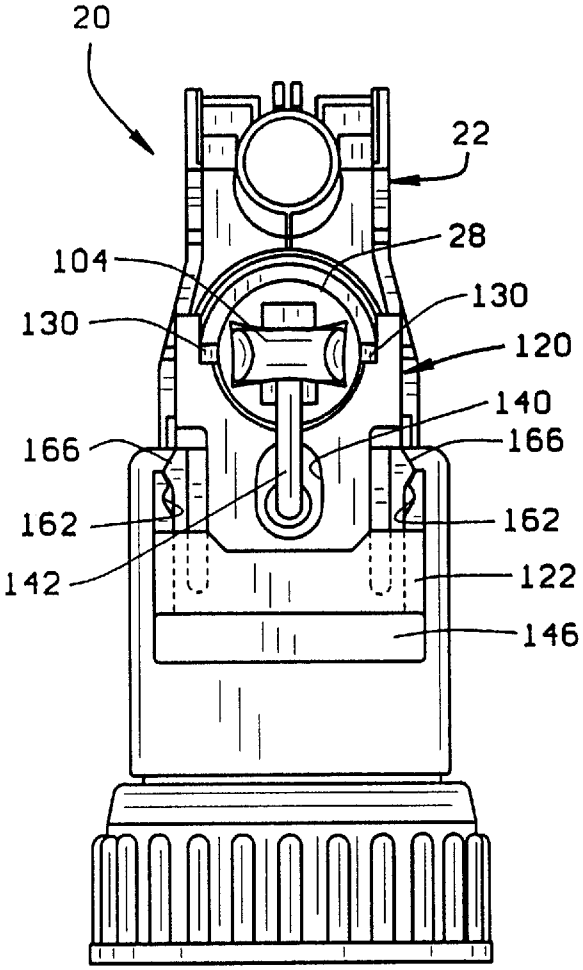
FIG. 2 is a front elevational view of the liquid dispenser of FIG. 1 with the nozzle assembly and trigger removed to show detail and with the locking mechanism shown in the locked position.

Referring to FIGS. 1 and 2, a trigger sprayer pump dispenser of the present invention is indicated in its entirety by the reference numeral 20. The dispenser 20 includes a dispenser body, generally indicated at 22. The dispenser body 22 comprises an upper housing member, generally indicated at 24, and a lower housing member, generally indicated at 26. Preferably, each of these components is of a polymeric material. However, it is to be understood that some or all of the components may be of other materials without departing from the scope of this invention.

The upper housing member 24 of the dispenser body 22 includes a pump cylinder 30, a circular back wall 32 substantially closing one end of the pump cylinder 30, a generally cylindric vertical formation 40 adjacent the circular back wall 32, and a horizontal tubular portion 42 extending forward from the vertical formation 40. The pump cylinder wall 30 includes a generally cylindric inner surface 44 for slidably receiving a pump piston 28. The inner surface 44 of the cylindric wall 30 and the circular back wall 32 define a pump chamber 46 open at one end for slidably receiving the pump piston 28.

The vertical formation 40 of the upper housing member 24 has a vertical bore 48 extending upward from the bottom of the vertical formation 40. A lower end of the vertical bore 48 receives the lower housing member 26 of the dispenser body 22. More particularly, the lower housing member 26 has a generally cylindric column 50 extending upward into the vertical bore 48 in sealing engagement with the vertical formation 40. The lower housing member 26 also has a nipple 52 extending down from the lower end of the cylindric column 50, and an annular flange 54. The nipple 52 and cylindric column 50 have inner surfaces defining an intake liquid flow path 56. The lower end of the nipple 52 defines an intake port 58 for the intake liquid flow path 56. A lateral opening 62 through the wall of the cylindric column 50 is aligned with an intake opening 64 through the circular back wall 32 of the upper housing member 24 to provide fluid communication between the intake liquid flow path 56 and the pump chamber 46. Thus, liquid flowing upward through the intake port 58 passes through the intake liquid flow path 56 through the aligned openings 62, 64 and into the pump chamber 46.

A threaded collar 66 is retained on the lower housing member 26 via the annular flange 54 for receiving a threaded neck of a liquid bottle (not shown). A dip tube 68 is sealingly engaged by and depends from the lower end of the nipple 52. The dip tube 68 is adapted to extend downward into liquid (not shown) within the bottle. The dip tube 68 constitutes a conduit for transporting liquid from the bottle to the intake port 58 of the intake liquid flow path 56.

A bottle vent opening 70 is in the lower housing member 26 for opening the top of the bottle to atmosphere. A plug 72 is integrally connected to the pump piston 28 and moveable therewith. The plug 72 is adapted for closing the bottle vent opening 70 when the dispenser 20 is not in use to prevent liquid from spilling out of the bottle via the opening.

The horizontal tubular portion 42 of the upper housing member 24 includes a horizontal bore 74 extending axially therethrough and in fluid communication with an upper end of the vertical bore 48 of the vertical formation 40. The vertical and horizontal bores 48, 74 comprise a discharge liquid flow path 76. A discharge opening 78 through the circular back wall 32 of the upper pump chamber 46 provides fluid communication between the pump chamber and the discharge liquid flow path 76. Liquid in the pump chamber 46 flows out of the discharge opening and through the discharge liquid flow path 76. The forward end of the horizontal tubular portion 42 has a nozzle-head receiving socket 80 for receiving a nozzle head 82. The socket 80 is coaxial with the horizontal bore 74 and in fluid communication with the discharge liquid flow path 76 so that liquid flowing through the discharge liquid flow path flows to the nozzle head 82.

A check valve 86 comprises a ball 90, and an annular valve seat 88 formed in the lower housing member 26 in the intake liquid flow path 56. The ball 90 of the check valve 86 is moveable between a closed position (shown in solid in FIG. 1) and an open position (shown in phantom in FIG. 1). In its closed position, the ball 90 seats against the valve seat 88 to block the intake liquid flow path 56 and thereby check fluid flow from the pump chamber 46 to the intake port 58. In its open position, the ball 90 is spaced above the valve seat 88 to permit liquid to flow upward around the ball and through the intake liquid flow path 56.

A pressure regulating valve 92 is moveable between a closed position and an open position. In the closed position, the valve 92 prevents liquid flow between the pump chamber 46 and horizontal bore 74. In the open position, the valve 92 permits liquid to flow from the pump chamber 46, through the discharge opening 78, into the discharge liquid flow path 76, then through the horizontal bore 74 and spinner assembly 84, and out through the nozzle head 82.

The pump piston 28 has a piston head 94 preferably formed of a suitable resilient material such as low density polyethylene. The piston head 94 comprises the rearward end (left most end as viewed in FIG. 1) of the pump piston 28. The piston head 94 is slidable within the pump chamber 46 and configured for sealing engagement with the cylindric inner surface 44 of the pump chamber 46 all around the piston head 94 to seal against leakage of fluid between the pump piston 28 and cylindric inner surface 44. The piston head 94 and pump chamber 46 define a variable volume fluid receiving cavity 96. The pump piston 28 is reciprocally slidable in the pump chamber 46 between a first (extended) position and a second (compressed) position along an axis X. When the pump piston 28 is in its extended position, the fluid receiving cavity 96 has a first (extended) volume. When the pump piston 28 is in its compressed position, the fluid receiving cavity 96 has a second (compressed) volume which is smaller than the extended volume.

Preferably, the pump piston 28 is moved from its extended position to its compressed position along axis X by a trigger 100. The trigger 100 is connected at its upper end to the upper housing member 24 for pivotal movement relative to the upper housing member (i.e., clockwise and counter-clockwise movement as viewed in FIG. 1). The trigger 100 has a camming surface 102 engageable with a forward end 104 (i.e., the right most end as viewed in FIG. 1) of the pump piston 28. Clockwise movement of the trigger 100 causes the camming surface 102 to push against the pump piston 28 and thereby move the pump piston rearwardly (i.e., from right to left as viewed in FIG. 1). A helical piston spring 106 is positioned between the circular back wall 32 of the pump chamber 46 and the pump piston 28 for urging the pump piston forward to its extended position.

Thus, in operation, the pump piston 28 is rearwardly moved from its extended position to its compressed position by manually squeezing the trigger 100, and is automatically returned to its extended position via the piston spring 106 when the operator releases the trigger. After the pump has been primed, i.e., after air has been vented from the fluid receiving cavity 96, forward movement of the pump piston 28 creates a vacuum (i.e., negative pressure) in the fluid receiving cavity 96. This vacuum causes liquid to be drawn from the bottle into the fluid receiving cavity 96 via the dip tube 68, intake port 58, and intake liquid flow path 56. Rearward movement of the pump piston 28 increases the pressure in the fluid receiving cavity 96. This increase in fluid pressure closes the check valve 86, opens the pressure regulating valve 92, and forces liquid out the discharge opening 78 to the discharge liquid flow path 76.

FIGS. 1–9 show the first embodiment of the present invention. In the first embodiment, a first locking mechanism, shown generally as 120, is mounted to the dispenser body 22 for linear movement relative thereto. As shown in FIGS. 1–5 the first locking mechanism is held to the dispenser body 22 by a body strap 122 which may be integral with the dispenser body 22. The first locking mechanism 120 is held in engagement with the dispenser body 22 by the housing strap 122 throughout its entire range of movement.

Figure 8:
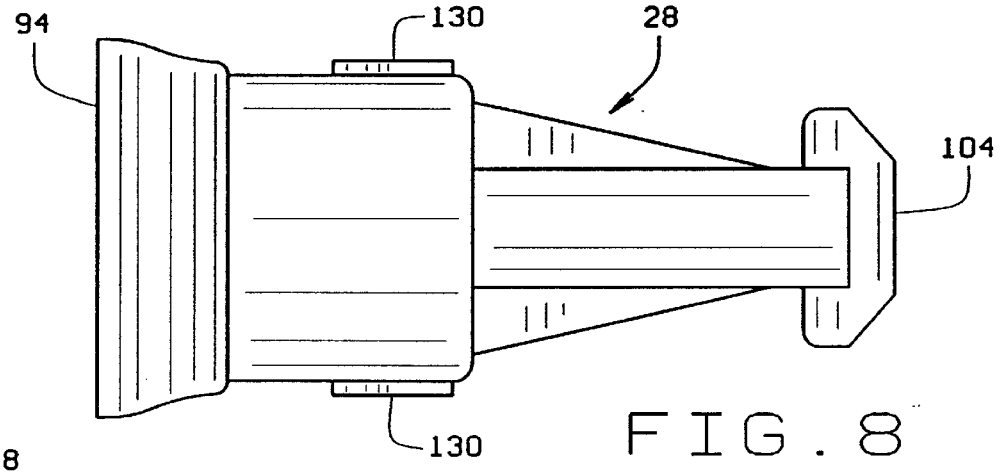
FIG. 8 is a top plan view of a pump piston of the liquid dispenser of FIGS. 1 through 5.
Figure 9:
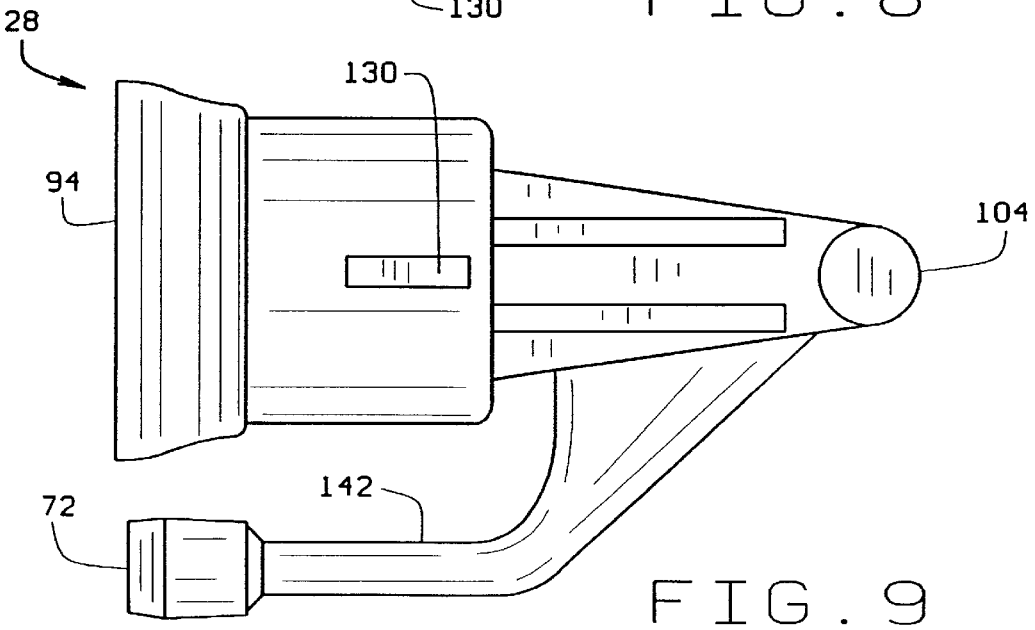
FIG. 9 is a side elevational view of the pump piston of FIG. 8.

As described above, the pump piston 28 is reciprocally slidable within the pump chamber 46 between forward and rearward positions. As best shown in FIGS. 8 and 9, the pump piston 28 includes a pair of jam ribs (or tabs) 130 which extend axially along, and protrude radially outwardly from, the exterior surface of the pump piston 28. Preferably, the jam ribs 130 are positioned at diametrically opposite portions of the pump piston 28.

The first locking mechanism 120 is linearly moveable relative to the pump piston 28 between locked and unlocked positions. Preferably, the linear movement of the first locking mechanism 120 is perpendicular to the linearly reciprocating movement of the pump piston 28.

Figure 3:
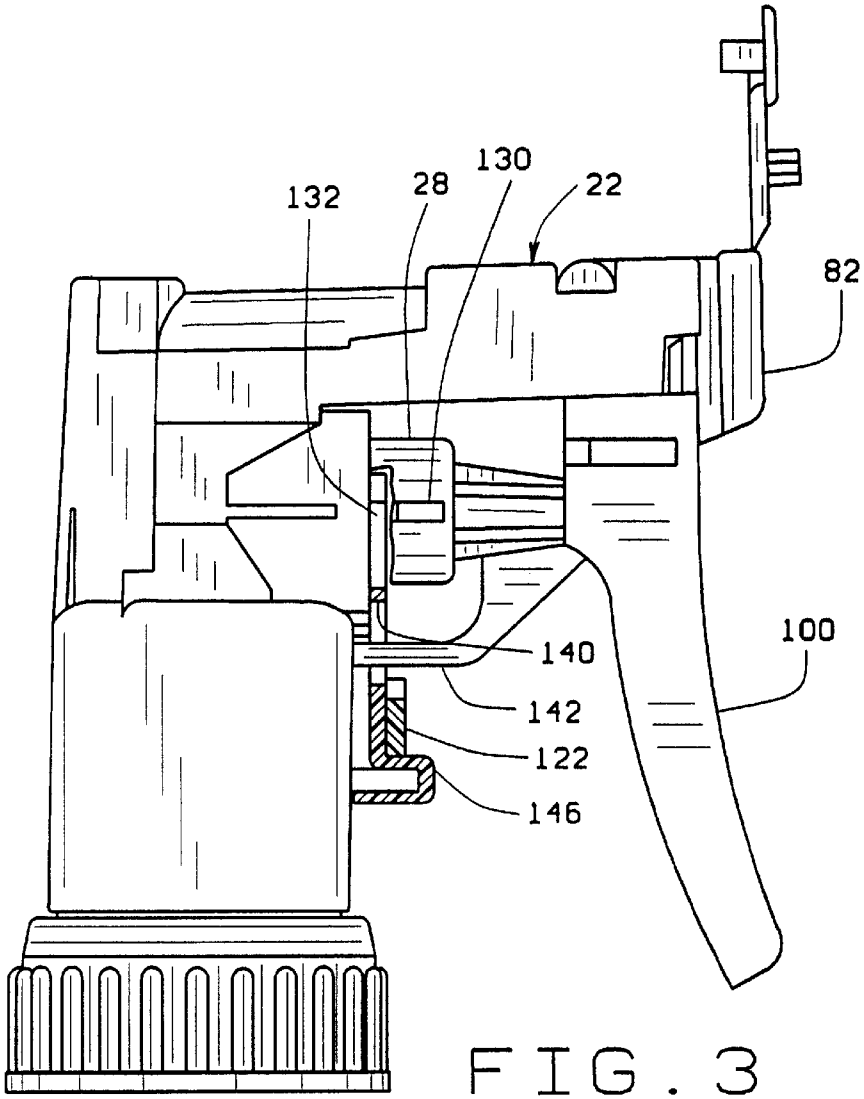
FIG. 3 is a side elevational view of the liquid dispenser of FIGS. 1 and 2 with portions broken away to show detail and with the locking mechanism shown in the locked position.
Figure 6:
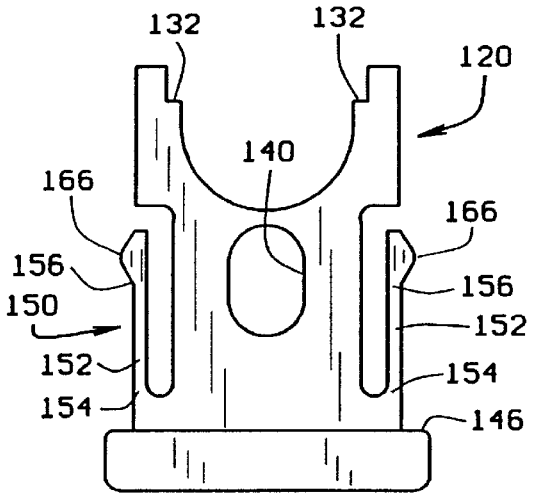
FIG. 6 is a front elevational view of the linearly moveable locking mechanism of the liquid dispenser of FIGS. 1 through 5.
Figure 7:
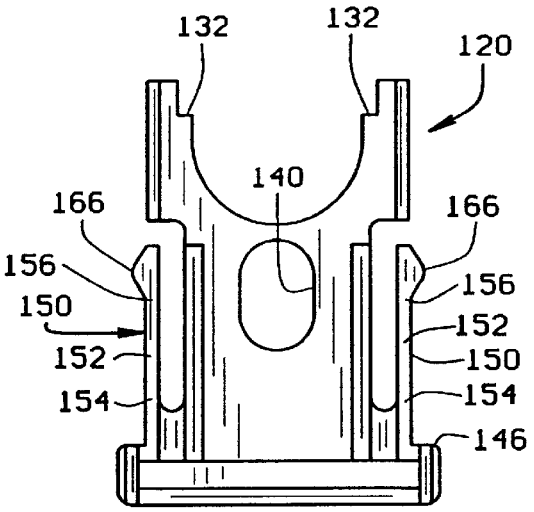
FIG. 7 is a rear elevational view of the linearly moveable locking mechanism of FIG. 6.

The locked (up) position of the first locking mechanism 120 is shown in FIGS. 1 through 3. The first locking mechanism 120 includes a U-shaped locking surface 132 at its upper end. The locking surface 132 is shaped to receive a portion of the pump piston 28 when the first locking mechanism 120 is in its locked position. When in the locked position, the first locking mechanism 120 is in engagement with both the pump piston 28 and the dispenser body 22 to fix the position of the pump piston 28 relative to the dispenser body 22. In the locked position, the locking surface 132 of the first locking mechanism 120 is positioned rearward of the jam ribs 130 to prevent axial movement of the pump piston 28 from its extended position to its compressed position.

Figure 5:
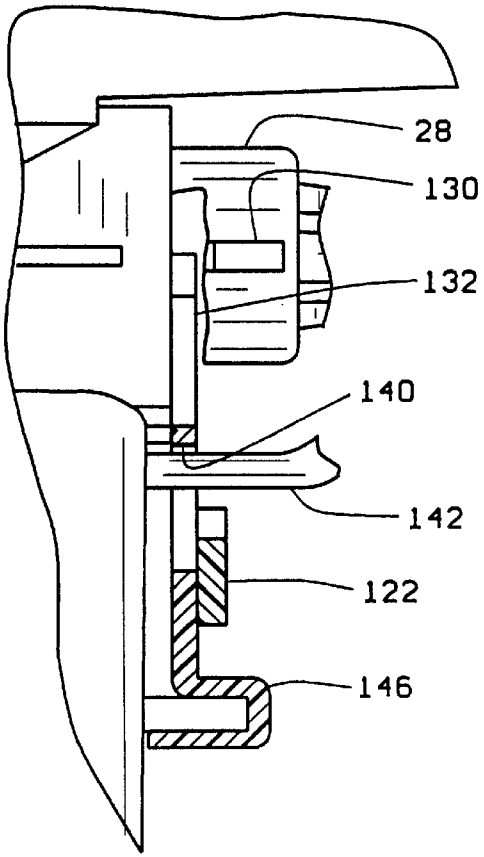
FIG. 5 is an enlarged, fragmented side elevational view of the liquid dispenser of FIG. 4 with portions broken away to show detail and with the locking mechanism shown in the unlocked position.

The unlocked (down) position of the first locking mechanism 120 is shown in FIGS. 3 and 5. In its unlocked position, the locking surface 132 of the first locking mechanism 120 is laterally spaced from the jam ribs 130 of the pump piston 28 to permit axial movement of the pump piston 28 relative to the dispenser body 22. Therefore, when in its unlocked position, the first locking mechanism 120 is out of engagement with the pump piston 28, leaving the pump piston 28 free to reciprocate axially within the pump cylinder 30, and permitting the pump dispenser 20 to be operated normally.

Preferably, the first locking mechanism 120 includes an opening 140 to permit a plug stem 142 to pass through the first locking mechanism as the pump piston 28 moves relative to the first locking mechanism 120. The first locking mechanism also includes a finger-engageable flange 146 configured for manual operation of the first locking mechanism 120 by a user of the dispenser 20.

Although the first embodiment of the present invention has been described with respect to jam ribs 130 extending radially outwardly from an exterior surface of the pump piston 28, the same locking function of the first locking mechanism 120 could be achieved with some other mechanism without departing from the scope of this invention. For example, the locking function could be achieved with a pump piston having an inwardly extending groove or recess that is releasably engageable with the locking surface 132 of the first locking mechanism 120.

Figure 4:
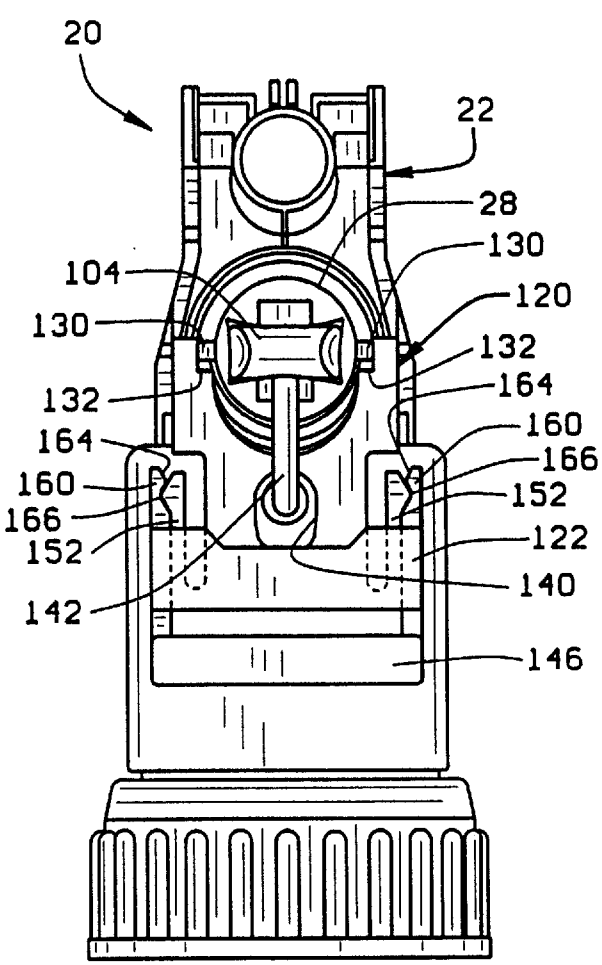
FIG. 4 is a front view of the liquid dispenser of FIGS. 1 and 2 with the nozzle assembly and trigger removed to show detail and with the locking mechanism shown in the unlocked position.

As shown in FIGS. 2 and 4, a second locking mechanism, indicated generally as 150, is configured to releasably engage the first locking mechanism 120 in a manner to releasably retain the first locking mechanism 120 in its locked and unlocked positions. Preferably, the first locking mechanism 120 includes a pair of resilient members 152 formed integrally therewith. Each of the resilient members 152 has a proximal end 154 attached to the first locking mechanism 120 and a distal end 156 configured for engagement with the second locking mechanism 150.

The second locking mechanism includes a pair of locking arms 160 which are fixed to the dispenser body 22 adjacent the body strap 122. Each of the locking arms 160 of the second locking mechanism includes a recessed surface 162 and an angled surface 164 adjacent the recessed surface. Each of the resilient members 152 includes a protrusion 166 at its distal end 156. The protrusions 158 serve as cam followers which are configured for camming engagement with the recessed surfaces 162 and angled surfaces 164 of the locking arms 160 as the first locking mechanism 120 is moved between its locked and unlocked positions.

The recessed surfaces 162 are configured for receiving the protrusions 166 of the resilient members 152 for a releasable snap-fit engagement of the first and second locking mechanisms when the first locking mechanism 120 is in its unlocked (down) position. The angled surfaces 164 are configured for engagement with the protrusions 166 of the resilient members 152 when the first locking mechanism 120 is in its locked (up) position.

The resiliency of the resilient members 152 permits them to be deflected inwardly away from the locking arms 160. However, due to their resiliency, the resilient members 152 are biased toward, and into engagement with, the locking arms 160 of the second locking mechanism 150.

When the protrusions 166 are in engagement with the recessed surfaces 162 of the locking arms 160, the first locking mechanism 120 is releasably held in its unlocked (down) position. As the first locking mechanism 120 is moved from its unlocked position toward its locked (up) position, the distal ends 156 of the resilient members 152 deflect inwardly so that the protrusions 166 disengage the recessed surfaces 162 of the locking arms 160. As the first locking mechanism 120 continues its movement toward the locked position, the protrusions 166 slide into engagement with the angled surfaces 164 of the locking arms 160. Thus, when the protrusions 166 are in engagement with the angled surfaces 164 of the locking arms 160, the first locking mechanism 120 is releasably held in its locked position.

FIGS. 10 through 17 show a second embodiment of the present invention. The second embodiment is similar in all respects to the first embodiment of the present invention except as described below.

Figure 11:
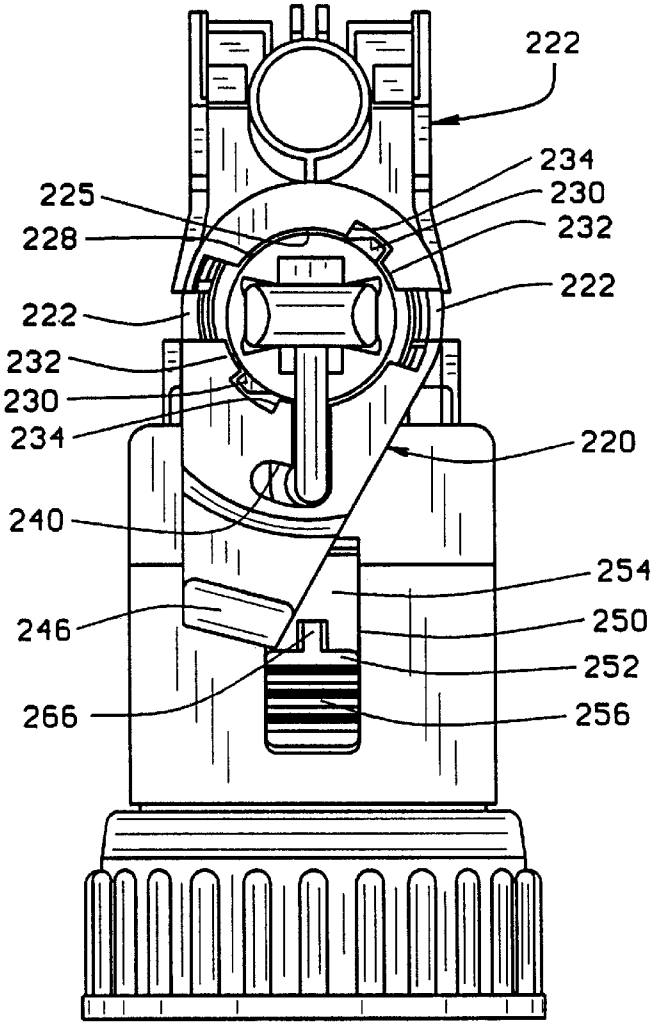
FIG. 11 is a front elevational view similar to FIG. 10 but showing the rotatable locking mechanism in an unlocked position.
Figure 10:
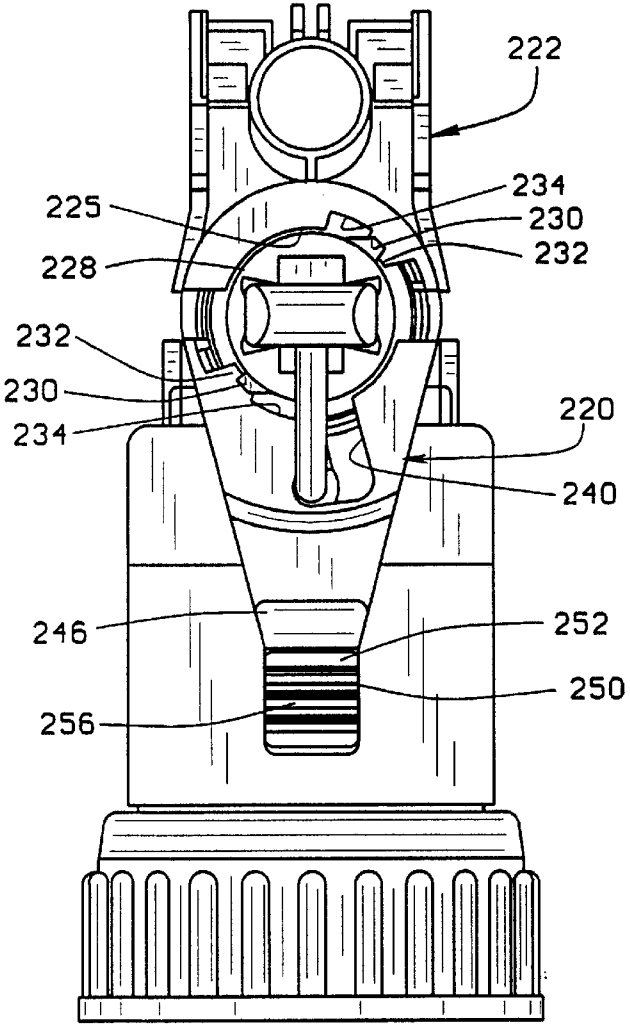
FIG. 10 is a front elevational view of another liquid dispenser of the present invention having a rotatable locking mechanism shown in a locked position, the nozzle assembly and trigger being removed to show detail.
Figure 12:
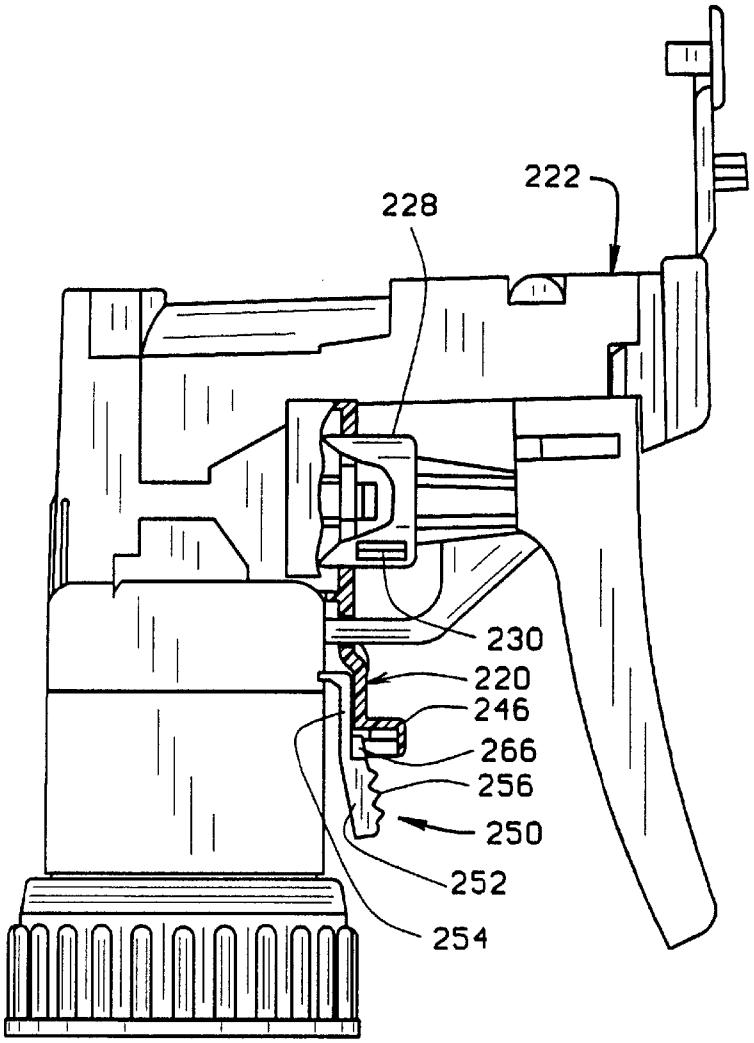
FIG. 12 is a side elevational view of the liquid dispenser of FIG. 10 with portions broken away to show detail and with a second locking mechanism in a locked position.
Figure 14:
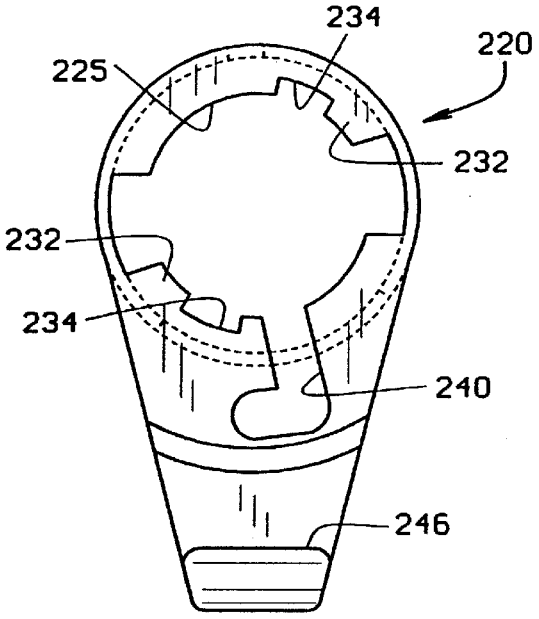
FIG. 14 is a front elevational view of the rotatable locking mechanism of the liquid dispenser of FIG. 10.
Figure 15:
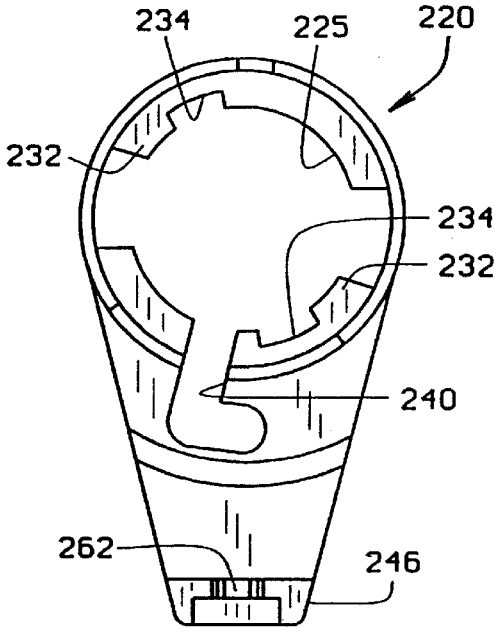
FIG. 15 is a rear elevational view of the rotatable locking mechanism of FIG. 14.

In the second embodiment, a first locking mechanism, shown generally as 220, is mounted to the dispenser body 222 for rotating movement relative thereto. As best shown in FIGS. 10 through 12, the first locking mechanism 220 is held to the dispenser body 222 in a snap-fit type connection, or other equivalent connection.

Figure 16:
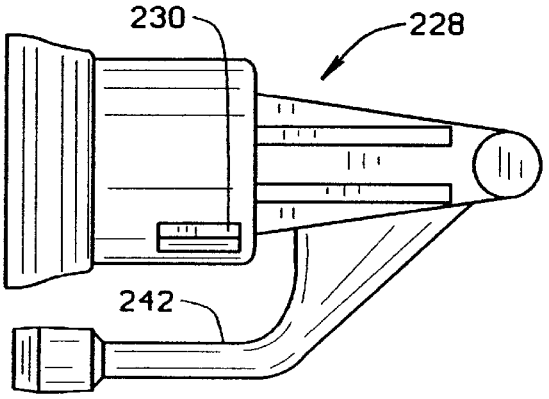
FIG. 16 is a side elevational view of a pump piston of the liquid dispenser of FIG. 10.
Figure 17:
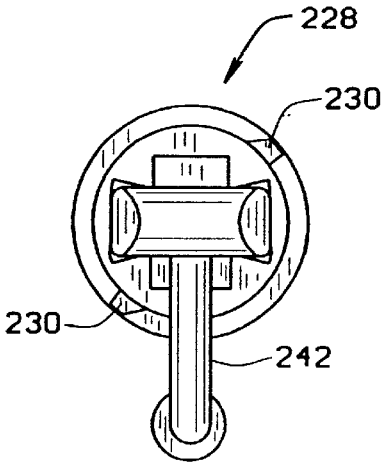
FIG. 17 is a front elevational view of the pump piston of FIG. 16.

As shown in FIGS. 16 and 17, the pump piston 228 includes a pair of jam ribs 230 which extend axially along, and protrude radially outwardly from, the exterior surface of the pump piston 228. Preferably, the jam ribs 230 are positioned on the exterior surface of the pump piston 228 at diametrically opposite portions of the pump piston 228 (see FIG. 17). The pump piston 228 of the second embodiment is similar in all other respects to the pump piston 28 of the first embodiment.

The first locking mechanism 220 is rotatable relative to the pump piston 228 between locked and unlocked positions. Preferably, the rotating movement of the first locking mechanism 220 is in a plane that is perpendicular to the axial movement of the pump piston 228.

The first locking mechanism 220 includes an opening 225 dimensioned to receive the pump piston 228 when the first locking mechanism 220 is mounted to the dispenser body 222. The first locking mechanism 220 also includes a pair of locking surfaces (or tabs) 232 configured to engage the jam ribs 230 when the first locking mechanism 220 is in its locked position, and a pair of slots 234 dimensioned to receive the jam ribs 230 when the first locking mechanism 220 is in its unlocked position. The locked position of the first locking mechanism 220 is shown in FIG. 10, and the unlocked position is shown in FIG. 11.

When in the locked position, the first locking mechanism 220 is in engagement with both the pump piston 228 and the dispenser body 222 to fix the position of the pump piston 228 relative to the dispenser body 222. As shown in FIG. 10, when in the locked position, the locking surfaces 232 of the first locking mechanism 220 releasably engages the jam ribs 230 in a manner to prevent axial movement of the pump piston 228 from its extended position to its compressed position.

As shown in FIG. 11, the first locking mechanism 220 is rotatable relative to the pump piston 228 and dispenser body 222 to its unlocked position to bring the slots 234 into alignment with the jam ribs 230. When the slots 234 and jam ribs 230 are in register with one another, the jam ribs 230 are permitted to pass through the slots 234 and the pump piston 228 is allowed to move axially relative to the dispenser body 222. Therefore, when the first locking mechanism 220 is in its unlocked position, the first locking mechanism 220 is out of engagement with the pump piston 228, leaving the pump piston 228 free to reciprocate axially within the pump cylinder, and permitting the pump dispenser to be operated normally.

Preferably, the first locking mechanism 220 includes a channel 240 to permit the plug stem 242 to pass through the first locking mechanism 220 as the pump piston 228 moves relative to the first locking mechanism 220. The first locking mechanism 220 also includes a finger-engageable lever 246 configured for manual operation of the first locking mechanism 220 by a user of the dispenser.

Figure 13:
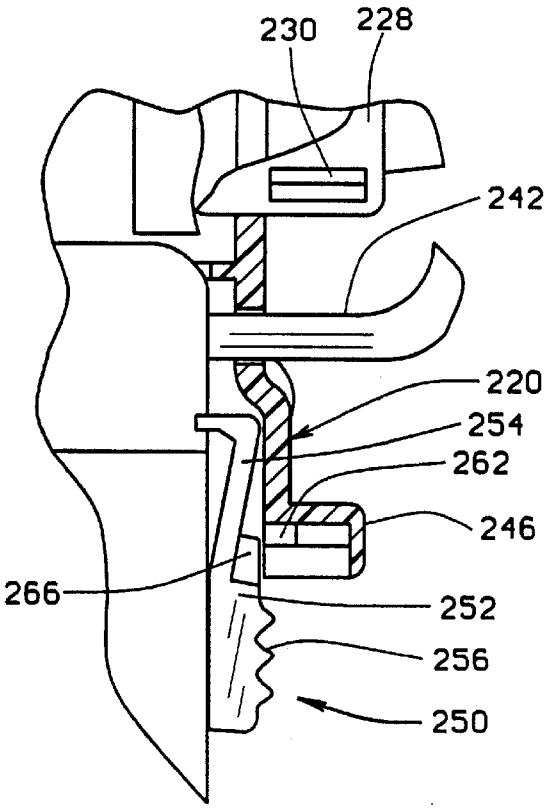
FIG. 13 is an enlarged, fragmented side elevational view of the liquid dispenser of FIG. 12, with portions broken away to show the second locking mechanism in an unlocked position.

In the second embodiment, the second locking mechanism 250 is moveable relative to the first locking mechanism 220 between first and second positions. As shown in FIGS. 10 and 12, the second locking mechanism 250 is configured to releasably retain the first locking mechanism 220 in a snap-fitting engagement when the second locking mechanism 250 is in its first position. As shown in FIGS. 11 and 13, the second locking mechanism 250 is out of engagement with the first locking mechanism 220 when the second locking mechanism 220 is in its second position.

Preferably, the second locking mechanism 250 includes an engaging portion 252 and a spring portion 254. The spring portion 254 is mounted to the dispenser body 222 for movement of the engaging portion 252 of the second locking mechanism 250 relative to the dispenser body 222 between its first and second positions. The engaging portion 252 of the second locking mechanism 250 includes an operating surface 256 configured for manual operation of the second locking mechanism 250 by the user. The spring portion 254 biases the engaging portion 252 of the second locking mechanism 250 toward its first position.

As shown in FIG. 12, the engaging portion 252 is engageable with the operating lever 246 of the first locking mechanism 220 to limit movement of the first locking mechanism 220 when the second locking mechanism 250 is in its first position. As shown in FIGS. 11 and 13, the engaging portion 252 may be moved to its second position, out of engagement with the operating lever 246 of the first locking mechanism 220, to permit rotating movement of the first locking mechanism 220.

Preferably, the engaging portion 252 of the second locking mechanism 250 includes a snap member 266, and the operating lever 246 of the first locking mechanism 220 includes a recess 262. The recess 262 is configured for receiving the snap member 266 in a snap-fitting engagement when the second locking mechanism 250 is in its first position to releasably retain the first locking mechanism 220 in its locked position.

Figure 19:
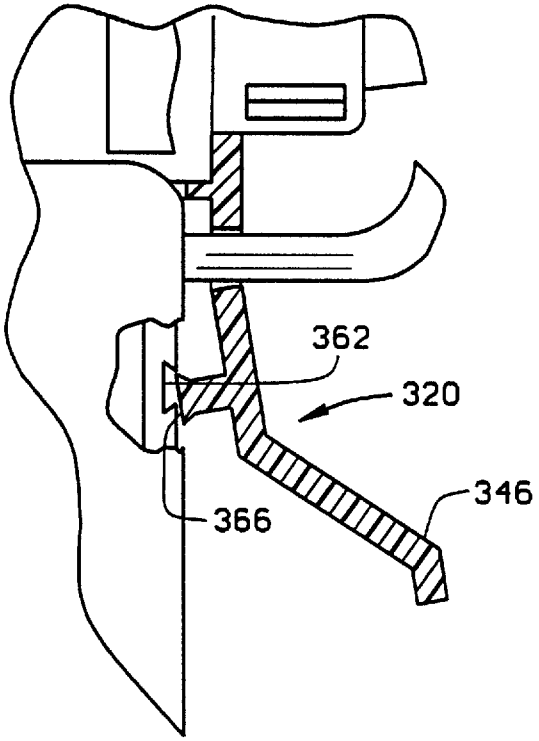
FIG. 19 is an enlarged, fragmented side elevational view of the liquid dispenser of FIG. 18, with portions broken away to show detail, and with the second locking mechanism shown in an unlocked position.
Figure 18:
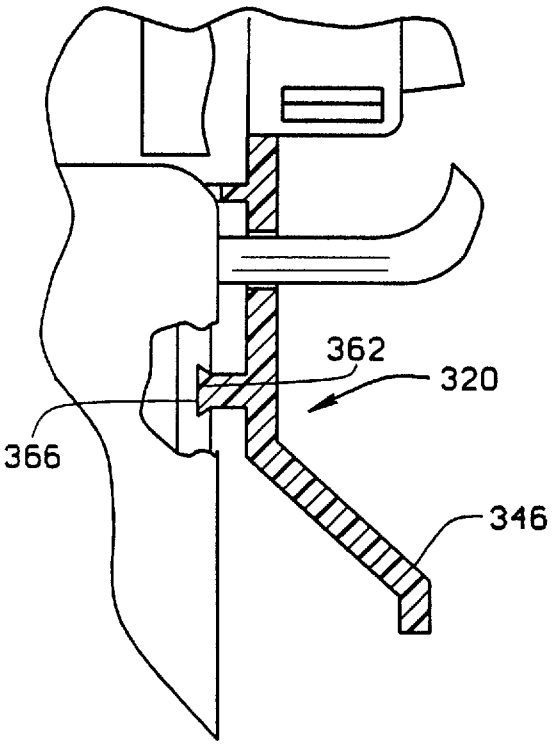
FIG. 18 is an enlarged, fragmented side elevational view of still another liquid dispenser of the present invention, with portions broken away to show detail, and with a second locking mechanism shown in a locked position.

FIGS. 18 and 19 show a third embodiment of the present invention. The third embodiment is similar in all respects to the second embodiment of the present invention except as described below.

In the third embodiment, a finger-engageable lever 346 of the first locking mechanism 320 includes a snap member 366 and the dispenser body 322 includes a recessed portion 362. The recessed portion 362 is configured to releasably retain the lever 346 in a snap-fitting engagement to thereby prevent rotating movement of the first locking mechanism 320. In the third embodiment, an independent second locking mechanism is not employed since the lever 346 of the first locking mechanism 320 is directly engageable with the dispenser body 322.

In view of the above, it will be seen that improvements over the prior art have been achieved and other advantageous results attained.

As various changes could be made in the above constructions without departing from the scope of the invention, it is intended that all matter contained in the above description or shown in the accompanying drawings shall be interpreted as illustrative and not in a limiting sense. It should be understood that other configurations of the present invention could be constructed, and different uses could be made, without departing from the scope of the invention as set forth in the following claims.

What is claimed is:

1. A child-resistant liquid dispenser comprising:

a dispenser body having an intake port and a discharge port;

a pump mechanism adjacent the dispenser body, the pump mechanism including a moveable member, the moveable member being moveable relative to the dispenser body between first and second positions, the pump mechanism being configured to draw liquid into the intake port and discharge it through the discharge port upon movement of the moveable member between its first and second positions;

a first locking mechanism adjacent the pump mechanism and dispenser body, the first locking mechanism being moveable between locked and unlocked positions, the first locking mechanism being engageable with both the moveable member of the pump mechanism and the dispenser body when the first locking mechanism is in its locked position in a manner to prevent movement of the moveable member from its first position to its second position, the first locking mechanism being configured to permit movement of the moveable member between its first and second positions when the first locking mechanism is in its unlocked position; and a second locking mechanism adjacent first locking mechanism, the second locking mechanism being configured to releasably engage the first locking mechanism in a manner to releasably retain the first locking mechanism in its locked position.

2. The liquid dispenser of claim 1 further comprising a trigger moveable relative to the dispenser body between first and second positions and engageable with the moveable member in a manner so that movement of the trigger between its first and second positions effectuates movement of the moveable member between its first and second positions.

3. The liquid dispenser of claim 2 wherein the trigger is pivotally connected to the dispenser body for pivotal movement of the trigger between its first and second positions.

4. The liquid dispenser of claim 1 wherein one of said first and second locking mechanisms includes a resilient member configured for a releasable snap-fit engagement with a surface of the other of the first and second locking mechanisms to releasably lock the first and second locking mechanisms to one another.

5. The liquid dispenser of claim 1 wherein the first locking mechanism includes a resilient member and the second locking mechanism is configured to releasably engage the resilient member in a manner to releasably retain the first and second locking mechanisms relative to one another.

6. The liquid dispenser of claim 4 wherein the resilient member and the first locking mechanism are of a monolithic piece.

7. The liquid dispenser of claim 1 wherein the first locking mechanism is linearly moveable relative to the pump mechanism and dispenser body between its locked and unlocked positions.

8. The liquid dispenser of claim 1 wherein the second locking mechanism is moveable relative to the first locking mechanism between first and second positions, the second locking mechanism being engageable with the first locking mechanism when the second locking mechanism is in its first position, the second locking mechanism being out of engagement with the first locking mechanism when the second locking mechanism is in its second position.

9. The liquid dispenser of claim 8 wherein the second locking mechanism is mounted to the dispenser body for movement relative to the dispenser body between its first and second positions.

10. The liquid dispenser of claim 9 wherein the second locking mechanism is configured to be directly moved by a user from its first position to its second position.

11. The liquid dispenser of claim 1 wherein the second locking mechanism includes an engaging portion and a spring portion, the engaging portion being moveable between first and second positions, the engaging portion being engageable with the first locking mechanism to limit movement of the first locking mechanism when the engaging portion is in its first position, the engaging portion being out of engagement with the first locking mechanism to permit movement of the first locking mechanism when the engaging portion is in its second position, the spring portion biasing the engaging portion in its first position.

12. The liquid dispenser of claim 1 wherein the first locking mechanism is rotatable relative to the pump mechanism and dispenser body between its locked and unlocked positions.

13. The liquid dispenser of claim 1 wherein the moveable member of the pump mechanism is moveable between its first and second positions along an axis, the first locking mechanism being configured to releasably engage the moveable member when the first locking mechanism is in its locked position in a manner to prevent movement of the moveable member from its first position to its second position, the first locking mechanism being laterally spaced from the moveable member when the first locking mechanism is in its unlocked position to permit movement of the moveable member along the axis.

14. A child-resistant liquid dispenser comprising:

a dispenser body having an intake port and a discharge port;

a pump mechanism adjacent the dispenser body, the pump mechanism including a moveable member, the moveable member being moveable relative to the dispenser body between first and second positions, the pump mechanism being configured to draw liquid into the intake port and discharge it through the discharge port upon movement of the moveable member between its first and second positions;

a locking mechanism adjacent the pump mechanism and dispenser body, the locking mechanism being moveable between locked and unlocked positions, the locking mechanism being engageable with both the moveable member of the pump mechanism and the dispenser body when the locking mechanism is in its locked position in a manner to prevent movement of the moveable member from its first position to its second position, the locking mechanism being configured to permit movement of the moveable member when the locking mechanism is in its unlocked position; and a trigger moveable relative to the dispenser body between first and second positions and engageable with the moveable member in a manner so that movement of the trigger between its first and second positions effectuates movement of the moveable member between its first and second positions.

15. The liquid dispenser of claim 14 wherein the trigger is pivotally connected to the dispenser body for pivotal movement of the trigger between its first and second positions.

16. The liquid dispenser of claim 15 wherein the locking mechanism is in engagement with the dispenser body throughout the movement of the locking mechanism between its locked and unlocked positions.

17. The liquid dispenser of claim 16 wherein the locking mechanism constitutes a first locking mechanism, and wherein the liquid dispenser further comprises:

a second locking mechanism adjacent first locking mechanism, the second locking mechanism being configured to releasably engage the first locking mechanism in a manner to releasably retain the first locking mechanism in its locked position.

18. The liquid dispenser of claim 15 wherein the moveable member of the pump mechanism is moveable between its first and second positions along an axis, the locking mechanism being configured to releasably engage the moveable member when the locking mechanism is in its locked position in a manner to prevent movement of the moveable member from its first position to its second position, the locking mechanism being laterally spaced from the moveable member when the locking mechanism is in its unlocked position to permit movement of the moveable member along the axis.

19. The liquid dispenser of claim 18 wherein the locking mechanism is linearly moveable relative to the pump mechanism and dispenser body between its locked and unlocked positions.

20. The liquid dispenser of claim 18 wherein the locking mechanism is rotatable relative to the pump mechanism and dispenser body between its locked and unlocked positions.

* * * * *

UNITED STATES PATENT AND TRADEMARK OFFICE

CERTIFICATE OF CORRECTION

PATENT NO. : 5,823,395

DATED : October 20, 1998

INVENTOR(S) : Foster, et al

It is certified that error appears in the above-identified patent and that said Letters Patent is hereby corrected as shown below:

Column 9, line 27, insert "the" before --first--.

Signed and Sealed this

Twenty-third Day of February, 1999

*Attest:*

Q. TODD DICKINSON

*Attesting Officer*

*Acting Commissioner of Patents and Trademarks*